US006427906B2

(12) United States Patent
Grueneberg

(10) Patent No.: US 6,427,906 B2
(45) Date of Patent: Aug. 6, 2002

(54) COLLAPSIBLE BOX

(75) Inventor: Bevan E. Grueneberg, Cedarburg, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 09/789,988

(22) Filed: Feb. 21, 2001

Related U.S. Application Data

(60) Provisional application No. 60/183,832, filed on Feb. 21, 2000.

(51) Int. Cl.[7] ..... B65D 5/36; B65D 25/04

(52) U.S. Cl. ..... 229/117.06; 229/117.24; 229/120.38

(58) Field of Search ..... 229/117.06, 120.24, 229/120.25, 120.26, 120.27, 117.01, 117.05, 120.38

(56) References Cited

U.S. PATENT DOCUMENTS 901,858 A * 10/1908 Williams ..... 229/117.06
930,835 A * 8/1909 Brown ..... 229/117.05
1,157,712 A * 10/1915 Miller ..... 229/117.06
2,344,567 A * 3/1944 Sidebotham ..... 229/117.05 X
3,065,876 A * 11/1962 Gioia ..... 229/120.27 X
3,402,849 A * 9/1968 Mattews et al. .... 229/120.15 X
3,850,362 A * 11/1974 Stollberg et al. ..... 229/117.06
3,921,893 A * 11/1975 Randle, Jr. ..... 229/120.38 X

* cited by examiner

*Primary Examiner*—Lee Young
*Assistant Examiner*—Tri M. Mai
(74) *Attorney, Agent, or Firm*—Quarles & Brady LLP

(57) ABSTRACT

A box made from sheet materials such as corrugated cardboard has two sides, two ends connected to the sides at foldable corners and each with a central fold line and a bottom connected to the sides at foldable corners but not connected to the ends. A center partition running from one end of the box to the other is hingedly connected to the ends and is not connected to the bottom. The bottom has a central fold, enabling it to fold away from the partition when the ends are folded about the side corners in the same direction, the ends folding in the middle relative to the partition, to collapse the box. The partition is made from two panels which are attached back-to-back to one another and each panel has end flaps at each end which make up the ends of the box.

7 Claims, 6 Drawing Sheets

COLLAPSIBLE BOX

CROSS-REFERENCE TO RELATED APPLICATION

This claims the benefit of U.S. Provisional Patent Application No. 60/183,832 filed Feb. 21, 2000.

STATEMENT CONCERNING FEDERALLY SPONSORED RESEARCH OR DEVELOPMENT

Not applicable.

BACKGROUND OF THE INVENTION

1. Field of the Invention

This invention relates to boxes, and in particular to reusable boxes which can be collapsed when empty.

2. Discussion of the Prior Art

Boxes or containers of many sorts are in current use. Corrugated cardboard boxes are especially popular, and often times these boxes are used to transport items, for example, empty containers like plastic bottles, to a plant for the bottles to be filled. Often times the corrugated containers are discarded after the empty bottles are taken out of them to be filled. This is done even though the corrugated containers are in good condition because the boxes are easier to replace than reuse.

The present invention provides a container or box which can be easily and inexpensively reused in such a situation.

SUMMARY OF THE INVENTION

A box of the present invention has two sides, two ends and a bottom, with a center partition running from one end of the box to the other, and the bottom connected along folds to opposite sides of the box. The bottom and ends each have a central fold, and the bottom is unconnected to the partition and is unconnected to the ends. The partition is hingedly connected to the ends, the sides and ends are hingedly connected to one another and the bottom is hingedly connected to the sides so that the box sides can be collapsed toward the partition by folding both ends relative to the sides in the same direction about the corners which connect the sides to the ends and folding the bottom relative to the sides by folding the bottom about the central fold line so as to move it away from the partition.

The partition is preferably made from two panels which are attached back-to-back to one another and each panel has end flaps at each end which make up the ends of the box. The end flaps have their ends attached to flaps of the side walls of the box.

Various different top configurations can be provided for the box. For example, a center closing lid may be provided. Alternatively, no lid may be provided and an upstanding tab may be provided on the center partition which fits into a corresponding slot in the bottom of the box for stacking the boxes in registration with one another.

In another embodiment, a handle may be cut out of the center partition to provide a central handle for carrying the container.

A box of the invention is preferably, but not exclusively, made from corrugated cardboard. It would also be possible to use other materials such as plastic, paperboard, etc.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENTS

Figure 1A:
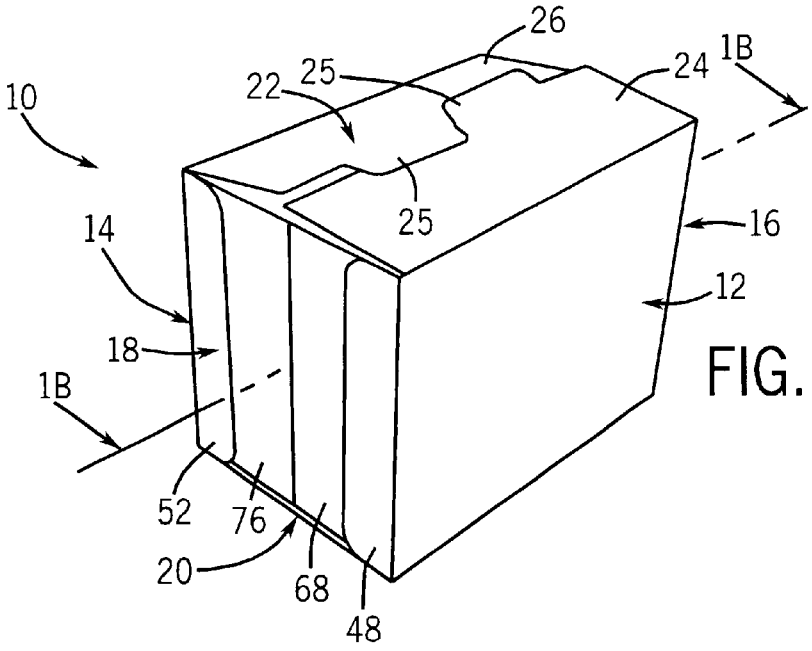
FIG. 1A is a perspective view of a container of the invention shown expanded.

FIG. 1A illustrates a box 10 of the invention shown in its expanded, or erect, condition. As such, it has sides 12, 14, ends 16, 18, a bottom 20, and a top 22. The box 10 may be made from any suitable material, but in the preferred embodiment is made from corrugated cardboard with the corrugations running in the directions indicated in FIGS. 4, 5, 7, 8 and 10. Other materials the box 10 could be made of are plastic, paperboard, etc.

Figure 3A:
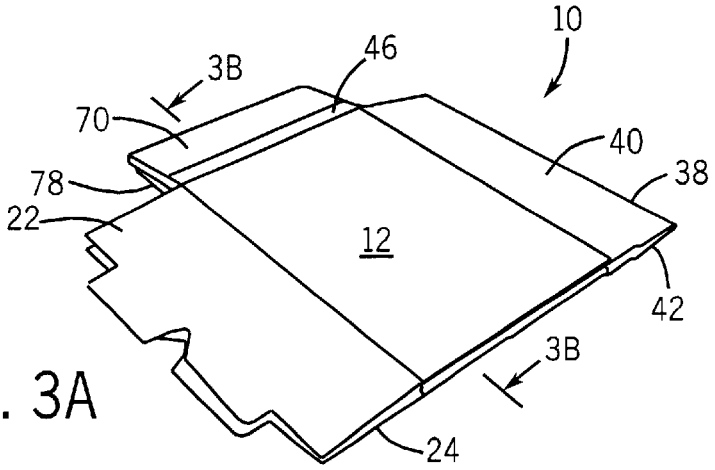
FIG. 3A is a view of the box of FIGS. 1A, 1B, and 2 with the box collapsed.
Figure 4:
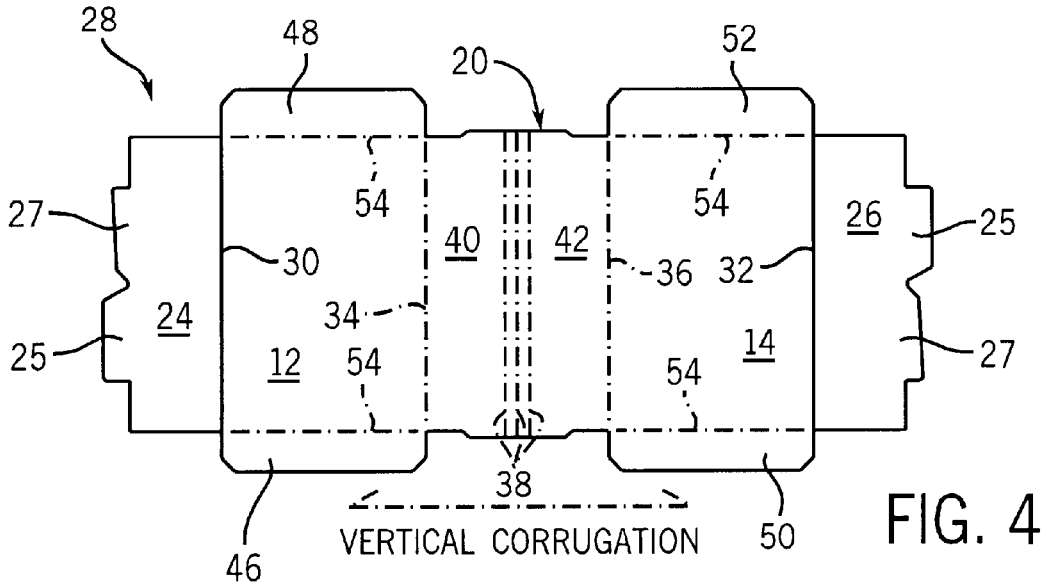
FIG. 4 is a plan view of a blank for making the lid, sides, and bottom of the container of FIGS. 1A–3B.
Figure 5:
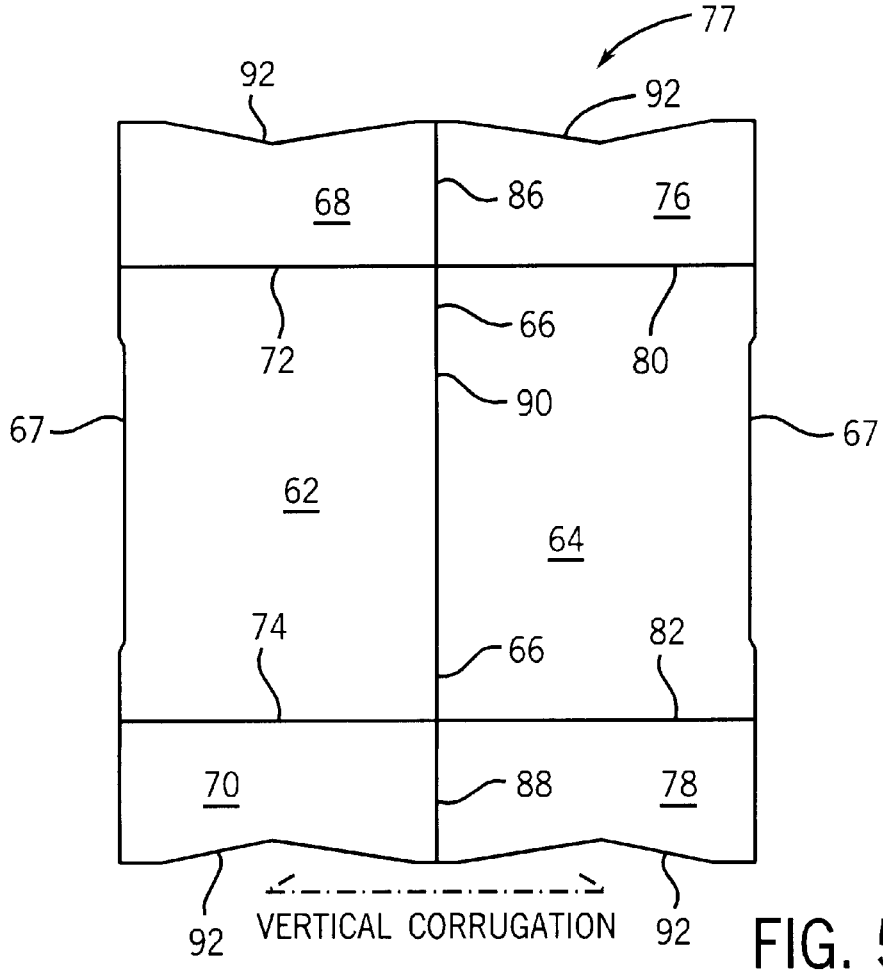
FIG. 5 is a plan view of a blank for making the ends and center partition of the box of FIGS. 1A–3B.

Referring to FIG. 4, the top 22, sides 12, 14, and bottom 20 are made from the blank illustrated. The top 22 is provided by flaps 24 and 26 at opposite ends of the blank 28, with the flap 24 hingedly connected to the top of side 12 along score line 30 and the flap 26 hingedly connected to the top of side 14 along score line 32. The flaps 24 and 26 have overlapping/underlapping tabs 25, 27 to help keep them closed. Side 12 is hingedly connected by score line 34 to one side of bottom 20 and side 14 is hingedly connected by score line 36 to the other side of bottom 20. Bottom 20 has three score lines 38 halfway between the score lines 34 and 36 which divides the bottom 20 into a panel 40 adjacent to side 12 and a panel 42 adjacent to side 14. The score lines 38 enable the bottom 20 to fold in its center along them when the box is collapsed as shown in FIG. 3A. The side panel 12 also has a pair of flaps 46, 48, one at each opposite end, and the side 14 also has a pair of flaps 50, 52, also one at each opposite end. The flaps 46, 48, 50, 52 are connected to their respective sides by score lines 54.

Figure 1B:
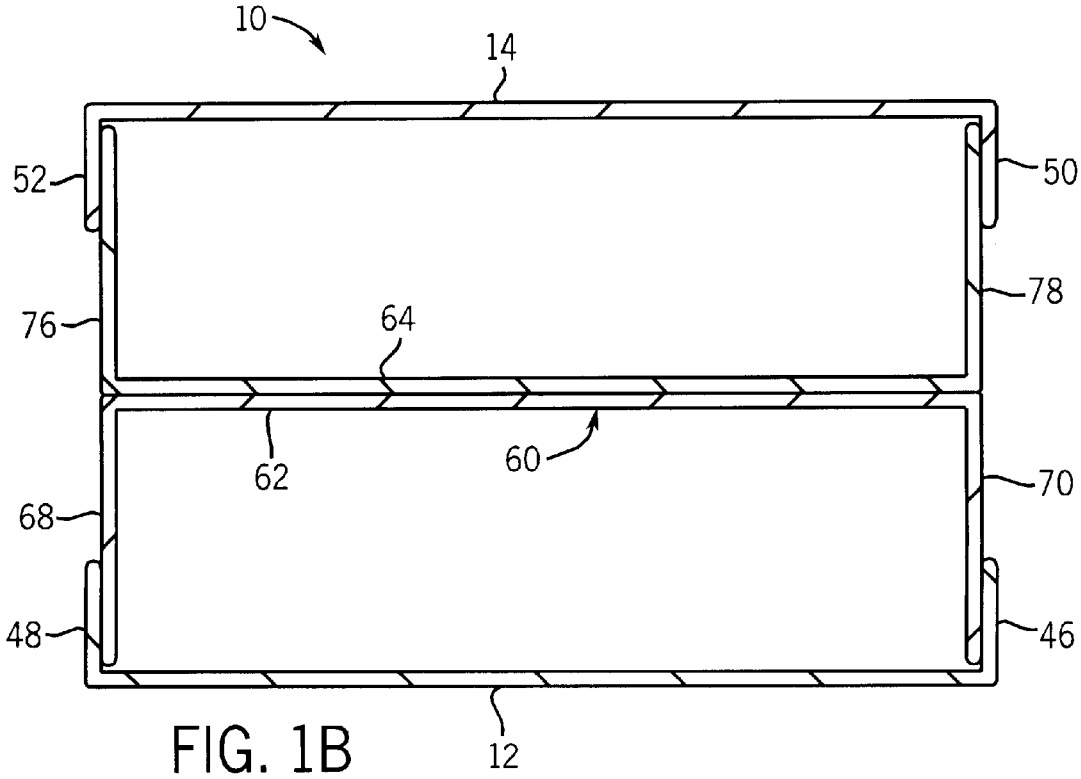
FIG. 1B is a cross-sectional view of the expanded container of FIG. 1A along the plane of the line 1B—1B of FIG. 1A.
Figure 2:
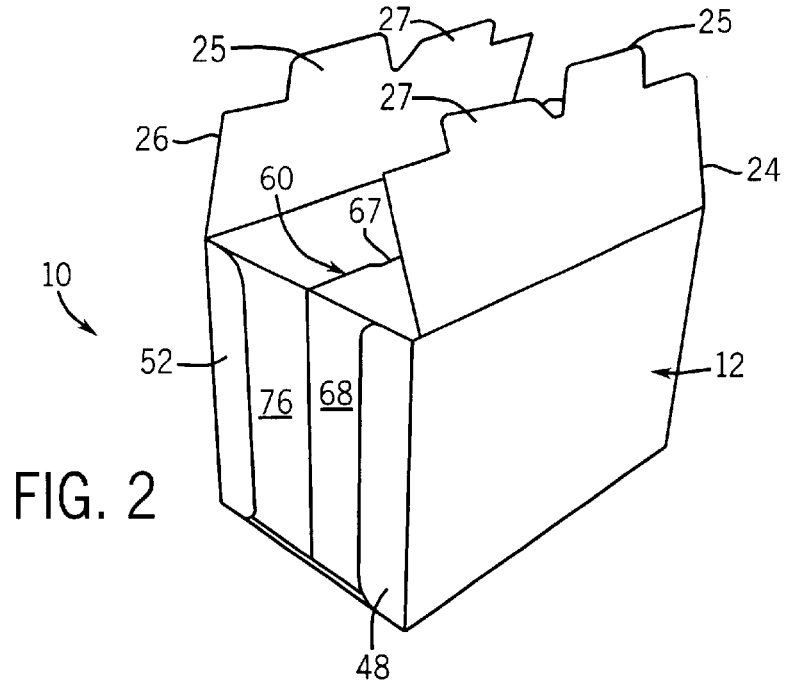
FIG. 2 is a view of the box of FIG. 1A with its cover open.

As shown in FIGS. 1B, 2, 3B, and 5, the box 10 has a center partition 60 which is made from two panels 62 and 64 which are connected by a score line 66, which may be cut through in its center portion 90. The panels 62 and 64 are folded along the score line 66 so as to be back to back, as shown in FIG. 1B and are glued, stapled, or otherwise affixed to one another back to back as shown. Panel 62 has end flaps 68 and 70 connected along respective score lines 72 and 74, and panel 64 has end flaps 76 and 78 connected by respective score lines 80 and 82. The score lines 72, 80 at one end and the score lines 74, 82 at the other end provide a central fold at each end of the box which enables each end to fold in the middle and relative to the partition 60. Cut lines 86 and 88 exist between the respective flaps 68 and 76 and 70 and 78. The flaps 46, 48, 50, and 52 are adhered to the adjacent panels 70, 68, 78, and 76 to form the ends of the box 10. The end edges 92 of the flaps 68,70, 76, 78 are V-shaped so that they are relieved in the middle to permit them to fold as shown at the left end in FIG. 3B with less spring back. The panels 62, 64 are relieved at their central top edges at 67 to make room for the tabs 25, 27 when the box is closed, so that the top is substantially flat when closed.

Figure 3B:
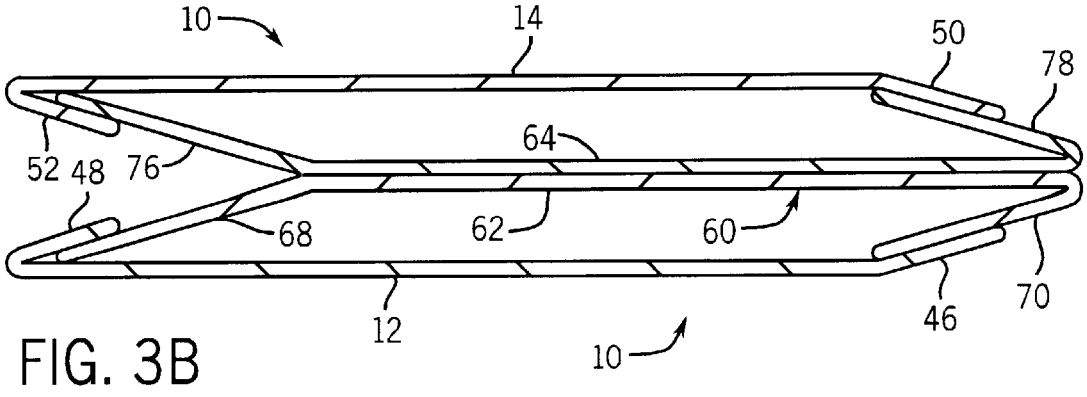
FIG. 3B is a cross-sectional view of the box collapsed from the plane of the line 3B—3B of FIG. 3A.

The box 10 is collapsed as illustrated in FIGS. 3A and 3B by moving the center partition 60 parallel to the side walls 12 and 14, folding the sides 12, 14 relative to the ends 16, 18 at the corners where they are connected. This causes the end walls 16 and 18 to fold in the middle where they are connected to the partition 60, and also causes the bottom 20 to fold in the middle into the position shown in FIGS. 3A and 3B.

Figure 6A:
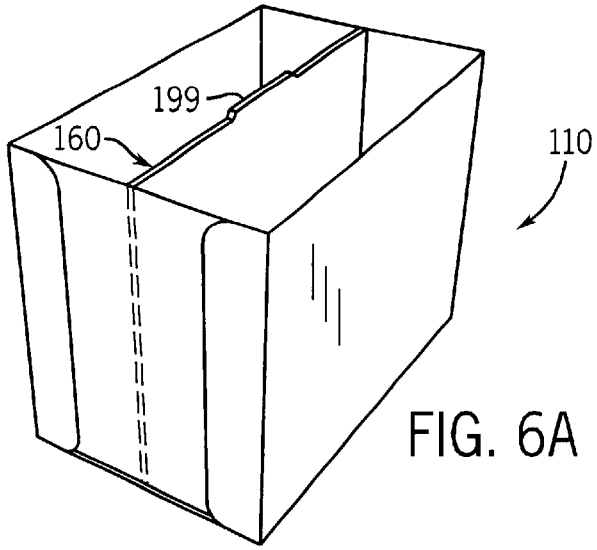
FIG. 6A is a view like FIG. 1A of a second embodiment of a box of the invention.
Figure 6B:
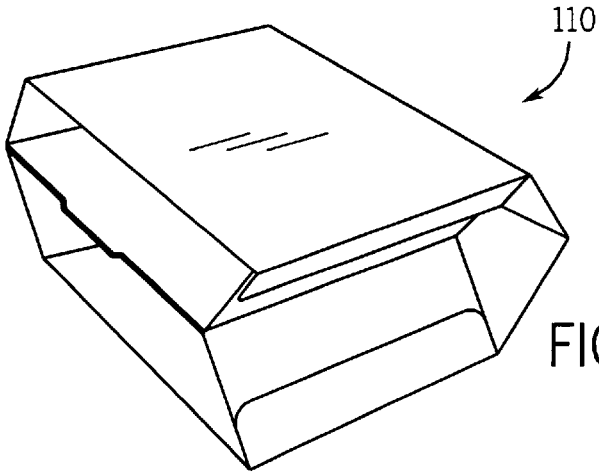
FIG. 6B is a perspective view of the box of FIG. 6A partially collapsed.
Figure 6C:
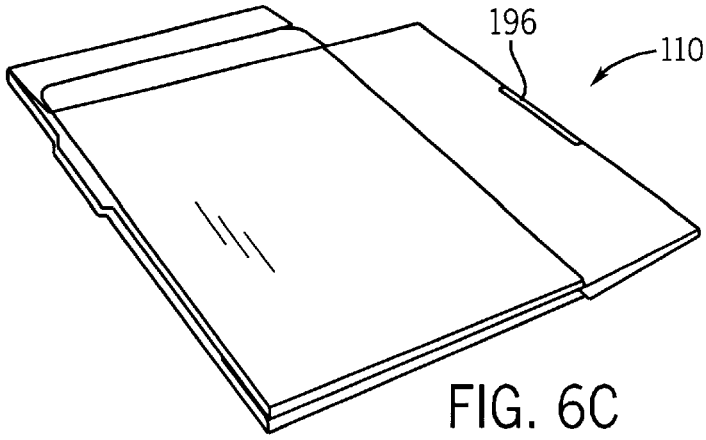
FIG. 6C is a view like FIG. 3A of the box of FIGS. 6A and 6B fully collapsed.
Figure 7:
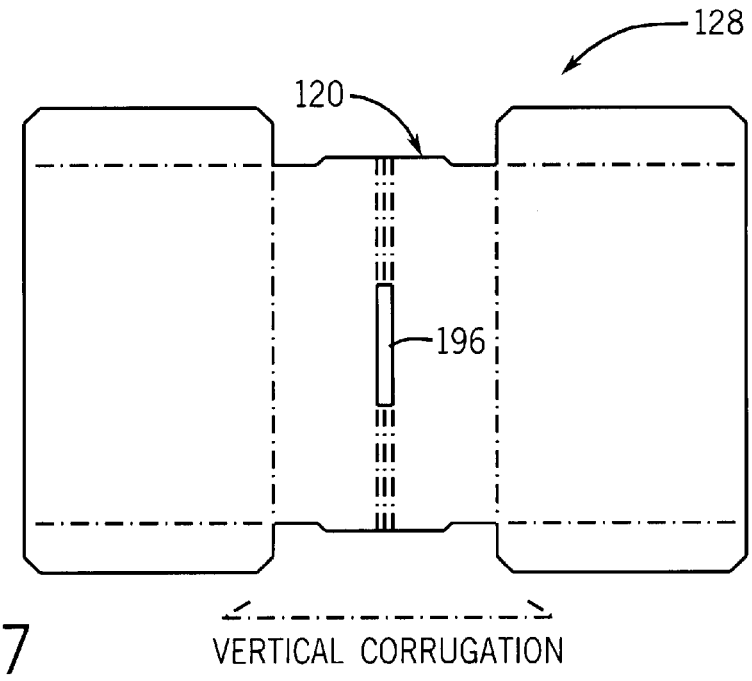
FIG. 7 is a plan view of a blank for making the sides and bottom for the box of FIGS. 6A–C.
Figure 8:
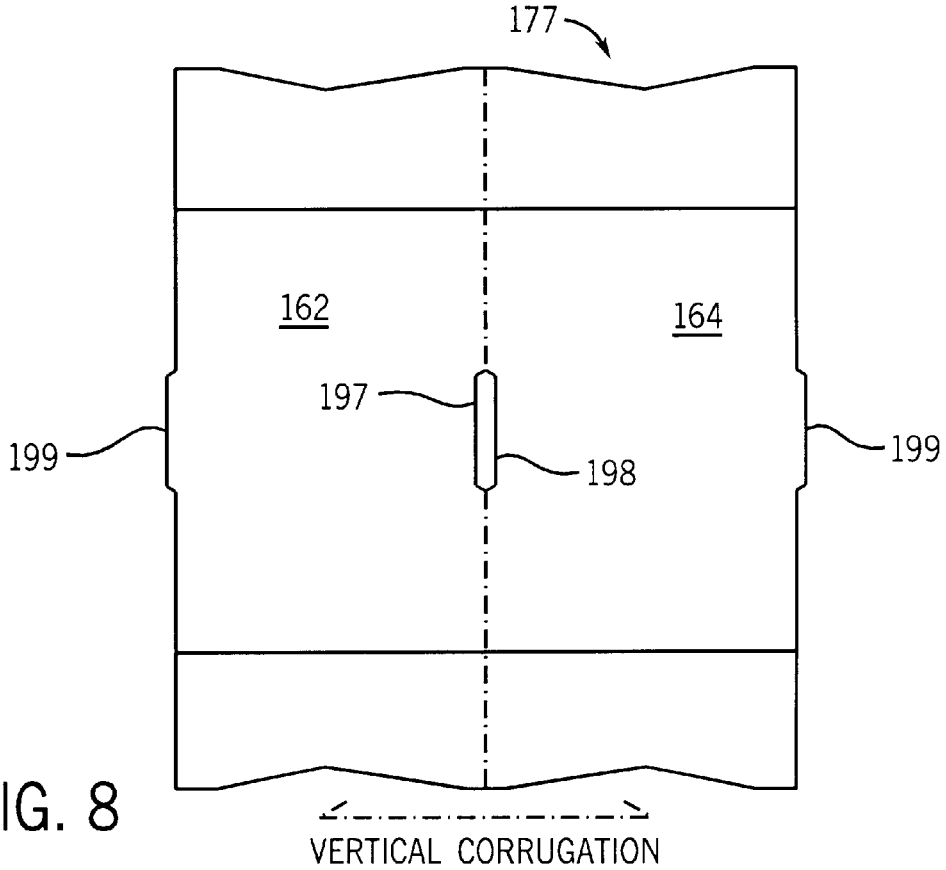
FIG. 8 is a plan view of a blank for making the ends and center partition of the box of FIGS. 6A–C.

FIGS. 6A–C illustrate a box 110 which is a second embodiment of the invention. The box 110 and components thereof are labeled with reference numbers corresponding to the reference numbers of the first embodiment, plus 100. The box 110 is essentially the same as box 10 except that no lid is provided and a tab 199 extends up from the center partition 160. In addition, as shown in the blanks of FIGS. 7 and 8 for the box 110, a slot 196 is provided in the bottom 120 and the central bottom of the panels 162 and 164 are relieved at 197 and 198 to make room for the tab 199 when two boxes 110 are stacked on top of one another. The tab 199 fitting in the slot 196 helps maintain the two stacked boxes in alignment with one another.

Figure 9:
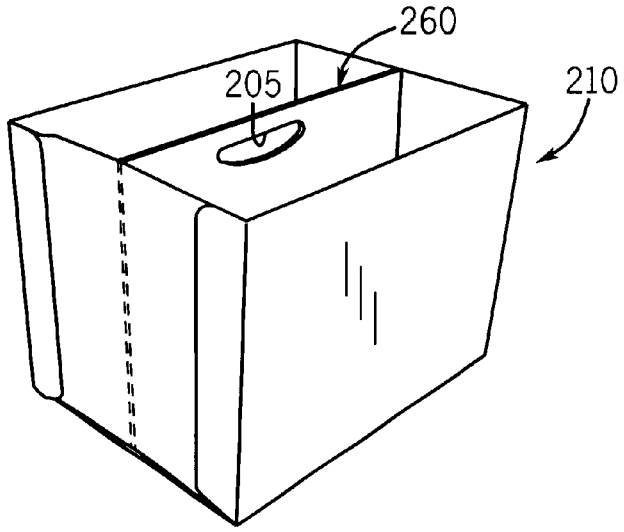
FIG. 9 is a view like FIG. 1A of a third embodiment of a box of the invention.
Figure 10:
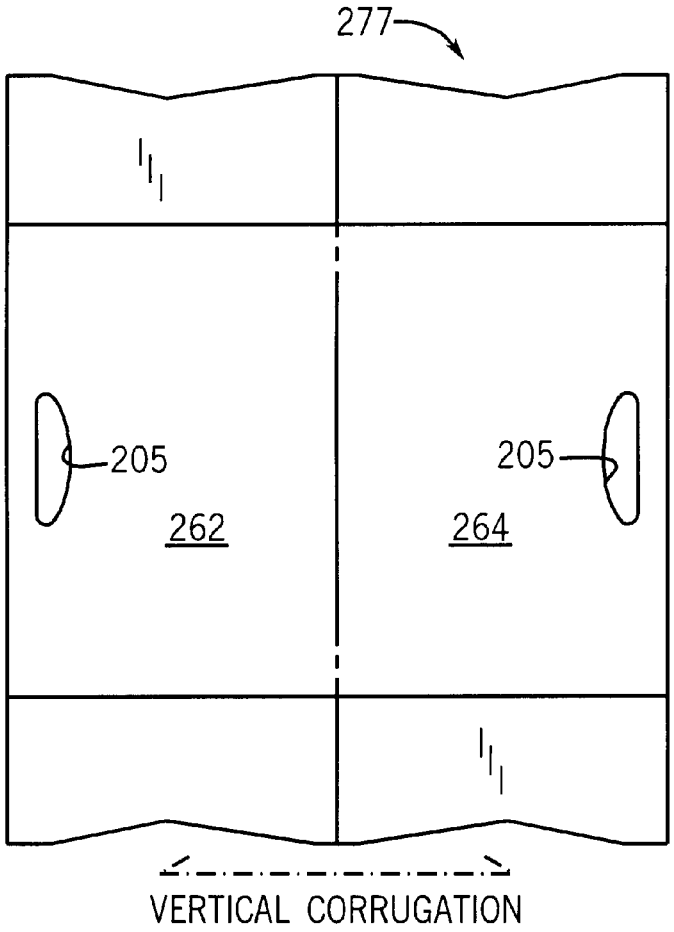
FIG.10 is a plan view of a blank for making the ends and center partition of the box of FIG. 9.

FIG. 9 illustrates a third embodiment 210 of a box of the invention. The box 110 and components thereof are labeled with reference numbers corresponding to the reference numbers of the first embodiment, plus 200. The box 210 is essentially the same as box 10 except that no lid is provided, the reliefs 67 are absent and a handle hole 205 is provided in the center partition 260. The handle hole 205, which is provided as a hole 205 in each panel 262, 264, serves as a convenient means to grab the center partition of the box 210 with one hand to carry the box 210.

Preferred embodiments of the invention have been described in considerable detail. Many modifications and variations to the preferred embodiments described will be apparent to those skilled in the art. Therefore, the invention should not be limited to the embodiments described, but should be defined by the claims which follow.

I claim:

1. In a box made of foldable sheet material, said box having two sides, two ends connecting the sides at corners between said sides and ends, a bottom, a center partition running from one end to the other end of the box, and the bottom connected to the sides of the box, the improvement wherein the bottom and ends each have a central fold, the bottom is unconnected to the partition and is unconnected to the ends and wherein the partition is hingedly connected to the ends, the sides and ends are hingedly connected to one another and the bottom is hingedly connected to the sides so that the sides can be collapsed toward the partition by folding both ends relative to the sides in the same direction about the corners which connect the sides to the ends and folding said bottom relative to the sides by said bottom folding about said central fold line so as to move away from said partition, wherein said partition is made from two panels which are attached back-to-back to one another, each said end having end flaps at each end which make up the ends of the box, said central fold of each end being provided at a pair of hinge joints which are between said end flaps and said panels of said partitions.

2. The improvement of claim 1, wherein said end flaps have ends which are attached to flaps of the sides of the box.

3. The improvement of claim 1, further comprising center closing cover panels attached to upper edges of said sides.

4. The improvement of claim 1, further comprising an upstanding tab on an upper edge of the center partition.

5. The improvement of claim 4, wherein said bottom includes a slot into which fits said upstanding tab of a similar box stacked beneath said bottom.

6. The improvement of claim 1, wherein a handle is cut out of the center partition to provide a central handle for carrying the box.

7. The improvement of claim 1, wherein said box is made from corrugated cardboard.

* * * * *